US007328957B2

(12) United States Patent
Fujii

(10) Patent No.: US 7,328,957 B2
(45) Date of Patent: Feb. 12, 2008

(54) LIQUID DISCHARGING HEAD AND RECORDING APPARATUS USING THE SAME

(75) Inventor: Yasuo Fujii, Hiratsuka (JP)

(73) Assignee: Canon Kabushiki Kaisha, Tokyo (JP)

( * ) Notice: Subject to any disclaimer, the term of this patent is extended or adjusted under 35 U.S.C. 154(b) by 339 days.

(21) Appl. No.: 11/139,525

(22) Filed: May 31, 2005

(65) Prior Publication Data

US 2005/0270319 A1 Dec. 8, 2005

(30) Foreign Application Priority Data

Jun. 7, 2004 (JP) ..... 2004-168822

(51) Int. Cl.
*B41J 29/38* (2006.01)

(52) U.S. Cl. ..... 347/12; 347/9

(58) Field of Classification Search ..... 347/12, 347/9

See application file for complete search history.

(56) References Cited

U.S. PATENT DOCUMENTS

| | | | | |
|---|---|---|---|---|
| 4,313,124 | A | 1/1982 | Hara | |
| 4,345,262 | A | 8/1982 | Shirato et al. | |
| 4,459,600 | A | 7/1984 | Sato et al. | |
| 4,463,359 | A | 7/1984 | Ayata et al. | |
| 4,558,333 | A | 12/1985 | Sugitani et al. | |
| 4,608,577 | A | 8/1986 | Hori | |
| 4,723,129 | A | 2/1988 | Endo et al. | |
| 4,740,796 | A | 4/1988 | Endo et al. | |
| 5,173,717 | A * | 12/1992 | Kishida et al. | 347/13 |
| 6,629,742 | B2 | 10/2003 | Fujii | |

FOREIGN PATENT DOCUMENTS

| | | |
|---|---|---|
| JP | 54-56847 | 5/1979 |
| JP | 59-123670 | 7/1984 |
| JP | 59-138461 | 8/1984 |
| JP | 60-71260 | 4/1985 |
| JP | 2002-321366 | 11/2002 |

* cited by examiner

*Primary Examiner*—Julian D. Huffman
(74) *Attorney, Agent, or Firm*—Fitzpatrick, Cella, Harper & Scinto

(57) ABSTRACT

A recording head and apparatus with an element substrate having a reduced area are provided. A plurality of recording elements for generating energy to discharge liquid are divided into a plurality of blocks Grp1 to GrpM. A first input circuit inputs a series of data signals and outputs the data signals to the plurality of blocks. The first input circuit is divided in correspondence to the blocks. A second input circuit inputs encoded block signals and outputs the block signals to the block. A plurality of output circuits drive drive circuits in accordance with the data signals from the first input circuit and the block signals from the second input circuit. The plurality of drive circuits supply currents to the recording elements and drive them.

7 Claims, 6 Drawing Sheets

LIQUID DISCHARGING HEAD AND RECORDING APPARATUS USING THE SAME

BACKGROUND OF THE INVENTION

1. Field of the Invention

The invention relates to a recording head and a recording apparatus using the recording head. More particularly, the invention relates to a recording head in which a plurality of recording elements arranged in a predetermined direction and a drive circuit to drive the recording elements are formed on a same element base substance and the recording elements are divisionally driven every plural blocks and to a recording apparatus using the recording head.

2. Related Background Art

For example, as information output apparatuses which are used for word processors, personal computers, facsimile apparatuses, and the like, recording apparatuses such as printers and the like for recording information such as desired characters, image, or the like onto a sheet-like recording medium such as paper, film, or the like are widely used.

Various systems have been known as recording systems of the printers. In recent years, among them, attention has been paid particularly to an ink jet system. The ink jet system has such various advantages that the information can be recorded onto a recording medium such as paper or the like in a contactless manner, a color image can be easily formed, it is silent, and the like.

As a construction of the recording apparatus of the ink jet recording system, a serial recording system in which the recording apparatus has a recording head for discharging ink in accordance with desired recording information and the recording is executed while reciprocatively scanning the recording head in the direction which crosses the feeding direction of the recording medium is widely used. The serial recording system has such advantages that it is reasonable in price, it can be easily miniaturized, and the like.

A method of discharging the ink by using a heat energy has been known as an ink discharging method in the ink jet recording system. In this case, in the recording head, an electrothermal converting element such as a heating element or the like is attached to a portion communicated with a discharge port for discharging an ink droplet. By supplying a current to the heating element for about a few microseconds, a bubble is generated in the ink and the ink droplet is discharged onto the recording medium by its pressure.

In such a recording head, a number of discharge ports and heating elements can be easily arranged at a high density, so that a high precision image can be recorded.

In such a recording head, if all of the heating elements are simultaneously driven, since a large current is momentarily supplied, a power source of a large capacity is necessary. Therefore, usually, tens to hundreds of heating elements are divided into a plurality of blocks and time-divisionally driven at slightly different timing every block, thereby suppressing a value of the current which flows momentarily to a small value.

By forming the drive circuit of the heating elements onto the element substrate of the recording head, the number of wirings between the recording head and the recording apparatus main body is reduced. An Si (silicon) wafer has widely been used as a material (element base substance) of the recording head element substrate having the heating elements and the drive circuits therein. An example in which the Si wafer is used as an element base substance has been disclosed in Japanese Patent Application Laid-Open No. 2002-321366.

Various constructions can be given as a construction of the circuit formed on the element substrate. An example of a layout construction of a typical recording head element substrate is shown in FIG. 6.

Referring to FIG. 6, two groups 623 and 624 for executing the ink discharging operation by signals from a recording apparatus main body (not shown) are symmetrically arranged so as to sandwich an ink supply port 600. Each of the groups 623 and 624 has: a terminal 621; a shift register 619; a latch circuit 617; a decoder 615; a wiring 605; gate circuits 603; a buffer 601; power transistors 609; and heating elements 611.

A clock and recording data in a serial format synchronized therewith are inputted from the recording apparatus to the recording head element substrate. The recording data is inputted to the terminal 621 of the recording head element substrate. The recording data is constructed by a data signal and a block signal. The data signal is a signal indicative of the block to be driven. The block signal is an encoded signal indicative of the heating element to be driven in the block.

Each bit of the recording data inputted to the terminal 621 shifts the shift register 619 synchronously with the clock and is held in the latch circuit 617. The portion of the block signal in the recording data held in the latch circuit 617 is decoded by the decoder 615 and outputted to the wiring 605. The portion of the data signal is directly outputted from the latch circuit 617 to the wiring 605.

A plurality of circuits each comprising the gate circuit 603, the power transistor 609, the heating element 611, and a level converter (not shown) are provided at the edge of the wiring 605. In the wiring 605, the portion showing selecting conditions of each heating element 611 is connected to each gate circuit 603. The gate circuit 603 is connected to the power transistor 609 through the level converter (not shown). The level converter is used to enhance driving ability of the power transistor 609 by stepping up an output of the gate circuit 603 and is driven by the buffer 601. The power transistor 609 is connected to the heating element 611 and the heating element 611 is driven by a signal from the power transistor 609.

With the construction as mentioned above, the recording head element substrate drives the heating elements 611 on the basis of the recording data from the recording apparatus and discharges the ink onto the recording medium.

In the conventional recording head having the recording head element substrate as shown in FIG. 6, generally, high picture quality and high processing speed are realized by increasing the number of heating elements. Specifically speaking, by increasing the number of bits of the data signal in the recording data, the number of heating elements which can simultaneously discharge the ink is increased, thereby raising a print speed.

Although an increase in number of heating elements 611 cannot be avoided, the number of power transistors 609 and the number of gate circuits 603 also increase in association with it. A size of the recording head element substrate increases in the layout direction of the heating elements 611 in association with the increase in number of heating elements.

Since the minimum time interval which is determined by discharging characteristics of the ink and at which the ink can be repetitively discharged from the same nozzle is equal to about tens of microseconds, there is a limitation in the increase in number of bits of the block signal in the recording data in order to increase the number of heating elements 611.

If the number of bits of the data signal is increased, the number of bits of each of the shift register 619 and the latch circuit 617 increases and the number of wirings included in the wiring 605 also increases. Thus, an area of the shift register 619 and latch circuit 617 arranged near the terminal 621 and, further, an area of the wiring 605 increase. The size of the recording head element substrate increases not only in the layout direction of the heating elements 611 but also in the direction perpendicular to the layout direction.

As mentioned above, in the construction of FIG. 6, when it is intended to realize high picture quality and a high speed, the number of head element substrates which can be obtained from one Si wafer decreases remarkably and costs of the head element substrate rise.

It is an object of the invention to provide a recording head whose costs are reduced by decreasing an area of an element substrate and a recording apparatus using such a recording head.

SUMMARY OF THE INVENTION

To accomplish the above object, according to the invention, there is provided a liquid discharging head comprising: a plurality of recording elements which are arranged in a predetermined direction and divided into a plurality of blocks and each of which generates an energy for discharging a liquid; a plurality of drive circuits for supplying currents to the recording elements and driving them; a first input circuit for inputting a series of data signals showing whether or not a predetermined recording element in the block should be driven with respect to the plurality of blocks and outputting the data signal to each of the blocks; a second input circuit for inputting one set of block signals encoded so as to indicate the predetermined recording element in the block and outputting the one set of block signals to the block; and a plurality of output circuits for outputting signals for driving the drive circuits in accordance with the data signals from the first input circuit and the block signals from the second input circuit, wherein the first input circuit is divided in correspondence to the blocks and each of the divided circuits is arranged in a position adjacent to the recording element of the corresponding block and the drive circuit and the output circuit corresponding to the recording element.

Other features and advantages of the present invention will be apparent from the following description taken in conjunction with the accompanying drawings, in which like reference characters designate the same or similar parts throughout the figures thereof.

Figure 1:
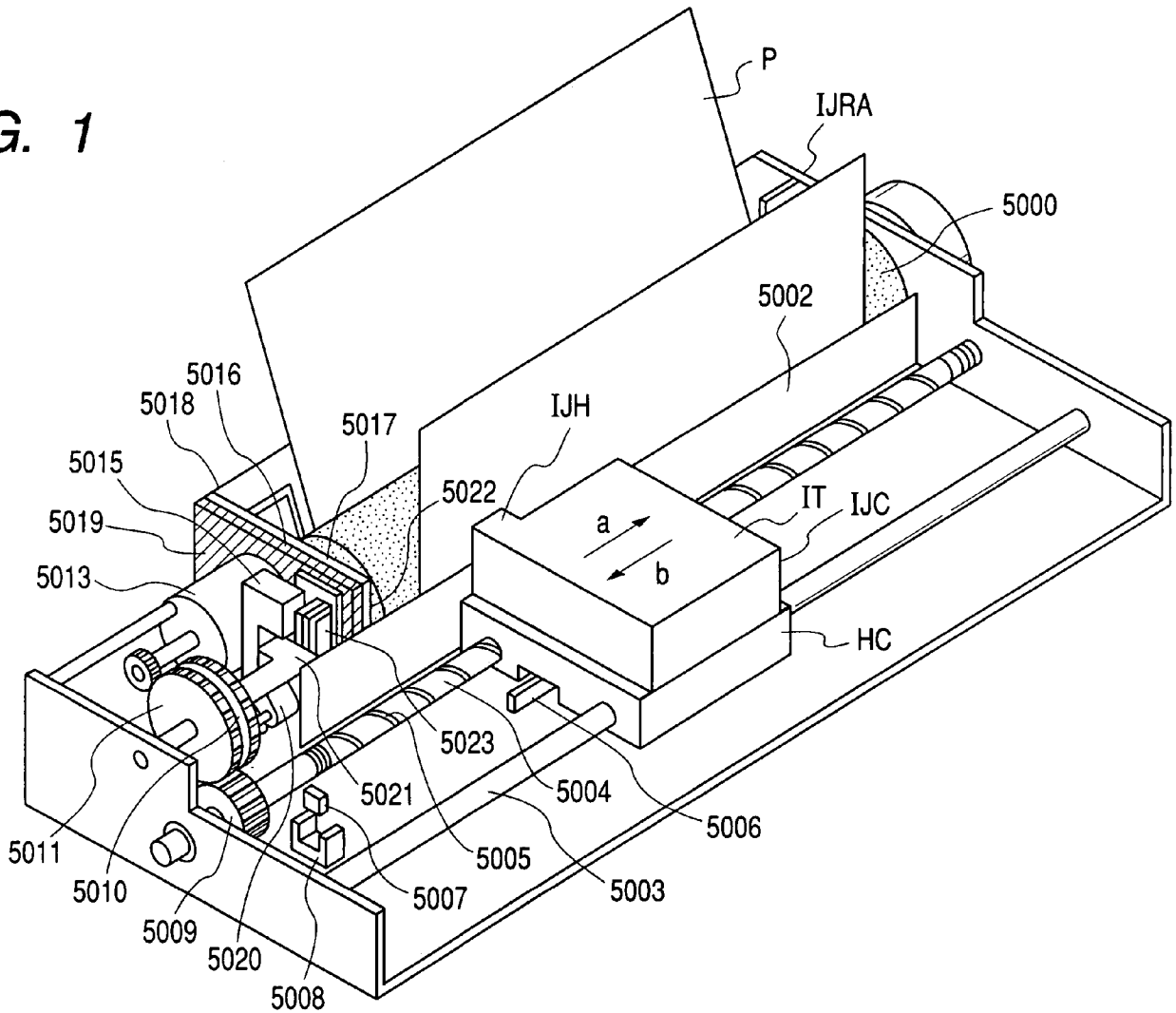
FIG. 1 is an external perspective view showing an outline of a construction of an ink jet printer as a typical embodiment of the invention.

The accompanying drawings, which are incorporated in and constitute a part of the specification, illustrate embodiments of the invention and, together with the description, serve to explain the principles of the invention.

DETAILED DESCRIPTION OF THE PREFERRED EMBODIMENTS

Preferred embodiments of the invention will now be described in detail with reference to the drawings.

Although a printer is mentioned as an example of a recording apparatus using an ink jet recording system in the embodiment, which will be explained hereinbelow, the invention is not limited to it. The invention can be widely applied to: a recording apparatus which is used as an outputting apparatus of an information apparatus such as copying apparatus, facsimile apparatus, word processor, computer, or the like; a liquid discharging apparatus which is used to manufacture a DNA chip, an organic transistor, a color filter, etc.; or the like.

In the specification, a terminology "record" (there is also a case where it is referred to as "print") incorporates not only a case where meaningful information such as character, figure, or the like is formed on a recording medium but also a case where meaningless information is formed. It is also assumed that "record" widely incorporates a case where an image, a design, a pattern, or the like is formed on the recording medium or the recording medium is modified irrespective of whether or not the formed information is information which has been visualized so that it can be perceived by the human sense of sight.

It is assumed that a terminology "recording medium" widely incorporates not only paper which is used in the general recording apparatuses but also a material such as cloth, plastic film, metal plate, glass, ceramics, wood, leather, or the like which can receive ink.

It is assumed that a terminology "ink" (there is also a case where it is referred to as "liquid") should be widely interpreted in a manner similar to the definition of "record (print)" mentioned above and widely incorporates a liquid which is applied onto the recording medium and can be used to form an image, a design, a pattern, or the like, to modify the recording medium, or to execute a treatment of the ink (for example, solidification or insolubilization of a coloring material in the ink which is applied to the recording medium).

A terminology "element base substance" (there is also a case where it is referred to as "element substrate") which is used hereinbelow does not indicate a simple base substance made of a silicon semiconductor but indicates a base substance formed with elements, wirings, and the like.

Further, an expression "on the element base substance" which is used in the following description denotes not only simply the surface on the element base substance but also the surface of the element base substance and the inside of the element base substance near the surface. A terminology "formed on (built-in)" in the specification does not denote that each of the separate elements is simply arranged on the base substance but it denotes that the elements are integratedly formed and manufactured on the element base substance by a manufacturing step or the like of a semiconductor circuit.

<Description of a Mechanism of an Apparatus Main Body>

FIG. 1 is an external perspective view showing an outline of a construction of an ink jet printer (hereinafter, simply referred to as a printer) IJRA as a typical embodiment of the invention.

In FIG. 1, a lead screw 5005 is rotated through driving force transfer gears 5009 to 5011 in association with the forward/reverse rotation of a driving motor 5013.

A carriage HC has a pin (not shown) which is come into engagement with a spiral groove 5004 of the lead screw 5005. The carriage HC is supported by a guide rail 5003 and reciprocatively moved in the directions shown by arrows a and b by the rotation of the lead screw 5005. An integrated ink jet cartridge IJC in which a recording head IJH and an ink tank IT are built is mounted in the carriage HC.

A paper pressing plate 5002 presses a recording medium P onto a platen 5000 along the moving direction of the carriage HC.

Photocouplers 5007 and 5008 confirm the existence of a lever 5006 of the carriage HC in a predetermined region in order to perform the switching or the like of the rotating direction of the motor 5013. By the confirmation of the lever 5006, it is detected that the carriage HC exists at the home position.

A cap member 5022 is supported by a supporting member 5016 and caps a front surface of the recording head IJH which arrives at a predetermined position. This operation is called capping. A suction device 5015 performs a suction recovery of the recording head IJH by sucking the inside of the cap through an opening 5023 in the cap.

A cleaning blade 5017 and a movable member 5019 are supported by a main body supporting plate 5018. The movable member 5019 enables the cleaning blade 5017 to be moved in the front/rear direction. By this structure, the cleaning blade 5017 is moved in the direction of the carriage HC, thereby performing the cleaning. The cleaning blade 5017 illustrated in FIG. 1 is shown as an example and, naturally, a device with another well-known structure can be also applied to the printer in the embodiment.

A lever 5021 is used to start the suction in the suction recovery and moved along with a cam 5020 which is come into engagement with the carriage HC. The cam 5020 and the lever 5021 are moved by a driving force transferred by a well-known transfer mechanism such as changeover of a clutch or the like from the driving motor 5013.

In the embodiment, each unit is constructed in such a manner that when the carriage HC reaches a region on the side of the home position, a desired process such as capping, cleaning, or suction recovery can be executed at a predetermined position by the operation of the lead screw 5005. However, the invention is not limited to such a construction but any other construction in which each unit executes a desired operation at well-known timing, so that the capping, the cleaning, or the suction recovery is executed can be also used.

Although an example of the exchangeable ink jet cartridge IJC in which the ink tank IT and the recording head IJH are integratedly formed is shown here, the invention is not limited to it. For example, it is possible to use a construction in which the ink tank IT and the recording head IJH can be separated and, when the ink is extinguished, only the ink tank IT is exchanged.

Desired information can be recorded onto the recording medium P by making predetermined control to the apparatus main body having the mechanism as mentioned above.

<Explanation of a Construction of a Control Circuit>

Figure 2:
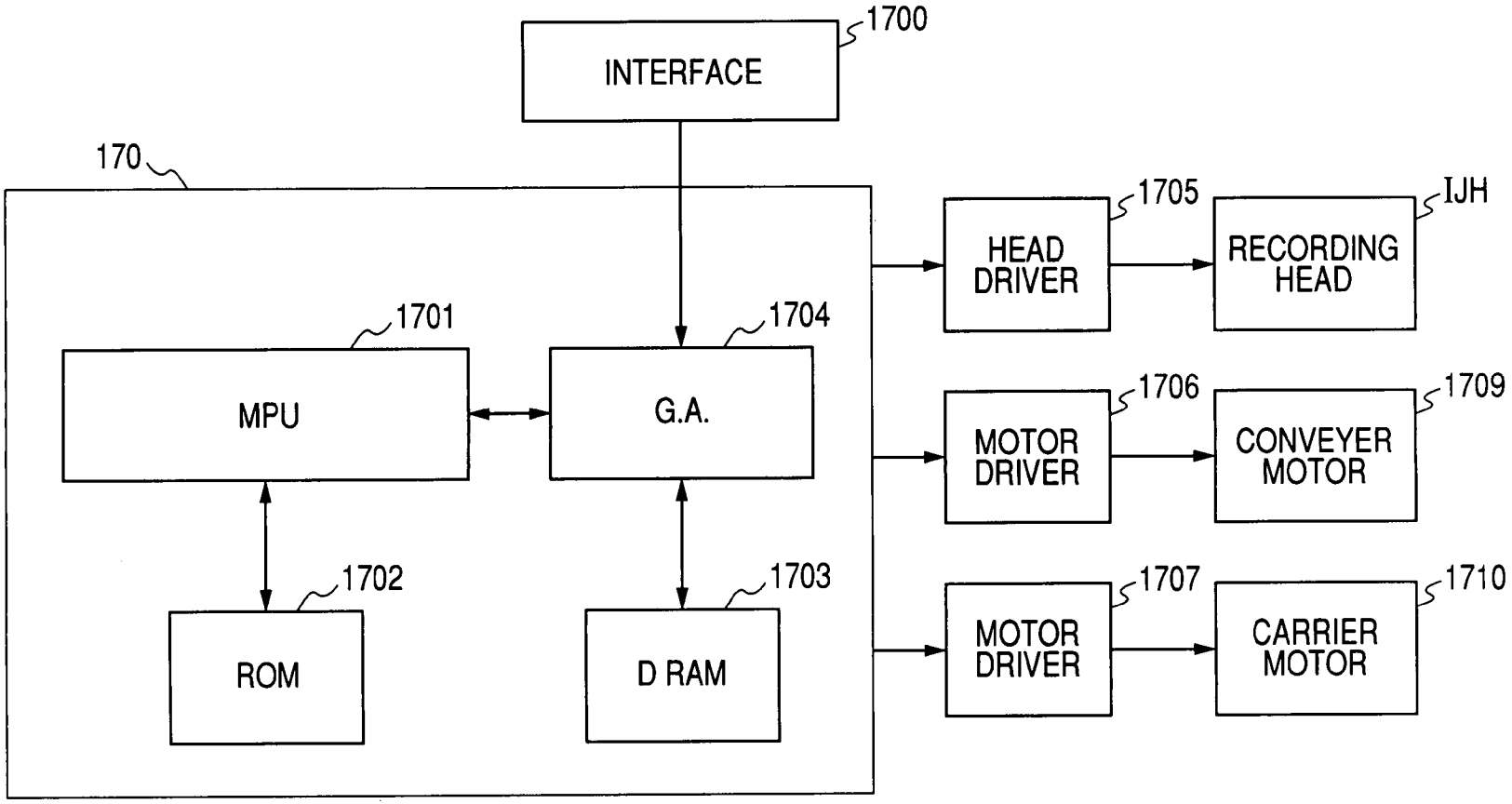
FIG. 2 is a block diagram showing a construction of a control circuit for making recording control in the ink jet printer in the embodiment.

FIG. 2 is a block diagram showing a construction of a control circuit for making recording control in the ink jet printer in the embodiment. Referring to FIG. 2, the control circuit has: an interface (I/F) 1700; a controlling and processing unit 170; a head driver 1705; and motor drivers 1706 and 1707. The controlling and processing unit 170 has: an MPU 1701; a ROM 1702; a DRAM 1703; and a gate array (GA) 1704.

A recording signal to instruct the recording control is inputted to the interface 1700.

The MPU 1701 executes a control program stored in the ROM 1702 and executes a process according to the recording signal inputted to the interface 1700, thereby supplying recording data to the recording head IJH, driving a conveyer motor 1709 to convey the recording medium P, and driving a carrier motor 1710 to convey the recording head IJH. When executing the control program, the MPU 1701 records the recording signal inputted to the interface 1700 and various data such as recording data which is supplied to the recording head IJH into the DRAM 1703 as a dynamic RAM. The gate array 1704 controls the supply of the recording data from the MPU 1701 to the recording head IJH. The gate array 1704 also controls data transfer among the interface 1700, the MPU 1701, and the RAM 1703.

The head driver 1705 drives the recording head IJH in accordance with the control by the controlling and processing unit 170. The motor drivers 1706 and 1707 drive the conveyer motor 1709 and the carrier motor 1710, respectively, in accordance with the control by the controlling and processing unit 170.

Although the construction in which the control program which is executed by the MPU 1701 has been stored in the ROM 1702 is shown as an example here, another construction can be also used. For example, it is also possible to construct in such a manner that the control circuit is provided with a storing medium such as an EEPROM or the like in which data can be erased/written and the control program in the storing medium is enabled to be updated by a host computer connected to the ink jet printer IJRA.

<Explanation of the Operation of the Control Circuit>

The operation of the control circuit having the construction described above will now be described.

When the recording signal inputted to the interface 1700 is supplied to the MPU 1701 through the gate array 1704, the MPU 1701 converts the recording signal into the recording data for printing, sends it to the head driver 1705, and supplies driving signals to the motor drivers 1706 and 1707.

The motor drivers 1706 and 1707 drive the conveyer motor 1709 and the carrier motor 1710 in accordance with the driving signals from the MPU 1701. The head driver 1705 drives the recording head IJH in association with them, so that desired information is recorded onto the recording medium P.

<Description of the Recording Head>

The recording head IJH in the embodiment will be described hereinbelow. In the recording head IJH in the embodiment, heating elements are used as recording elements. Power transistors are used as drive circuits for driving the heating elements.

Two sets of heating elements each consisting of (16×M) elements, that is, the total (16×M×2) of heating elements are provided for the recording head IJH. Each set of heating elements are divided into M blocks each consisting of 16 heating elements. One of the heating elements of each block is simultaneously driven.

Figure 3:
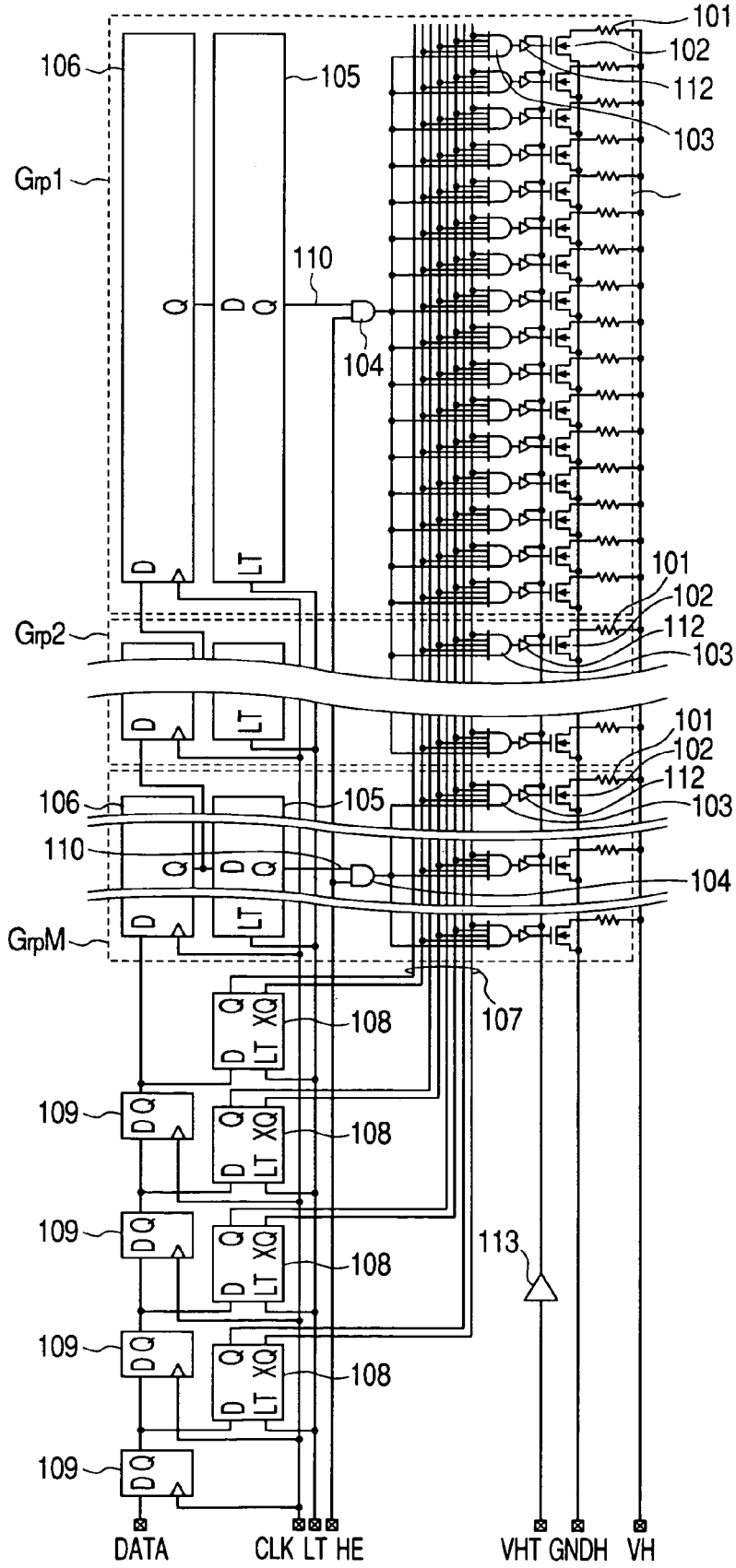
FIG. 3 is a circuit diagram showing a circuit built in a recording head element substrate for a set of heating elements in a recording head in the embodiment.

FIG. 3 is a circuit diagram showing a circuit formed on (built in) a recording head element substrate for a set of heating elements in the recording head IJH in the embodiment. Referring to FIG. 3, M blocks Grp1 to GrpM, four latch circuits 109, four latch circuits 108, and one VHT buffer 113 are formed on one set of heating elements. The M blocks Grp1 to GrpM have the same construction.

Each block has: one latch circuit 105; one latch circuit 106; one AND circuit 104; 16 AND circuits 103; 16 level converters 112; 16 power transistors 102; and 16 heating elements 101.

Power voltages VH and VHT, a grounding voltage GNDH, recording data DATA, a clock signal CLK, an enable signal HE, and a latch signal LT are supplied to the circuit in FIG. 3 formed in the recording head IJH. The power voltage VH is a power source to drive the heating elements 101. The power voltage VHT is a power source to improve drivability of the drivers for driving the heating elements 101.

The circuit in FIG. 3 to which the power source has been applied operates in accordance with the recording data DATA, the clock signal CLK, the enable signal HE, and the latch signal LT. The recording data DATA is constructed by a data signal and a block signal. The data signal is a signal indicative of the block to be driven. The block signal is an encoded signal indicative of the heating elements to be driven in the block.

A shift register is constructed by: the latch circuit 106 of each of the blocks Grp1 to GrpM; and the four latch circuits 109 which are not included in any blocks. The shift register sequentially and serially shifts the recording data DATA synchronously with a leading edge and a trailing edge of the clock signal CLK.

Synchronously with the latch signal LT, the latch circuit 105 latches the signal latched in the latch circuit 106. Thus, the data signal in the recording data is latched into the latch circuit 105. The AND circuit 104 is connected to an output of the latch circuit 105 by a wiring 110 and obtains the AND of the enable signal HE and the data signal latched in the latch circuit 105. As mentioned above, the circuit comprising the latch circuit 105, the latch circuit 106, and the AND circuit 104 of each of the blocks Grp1 to GrpM inputs the recording data. This circuit operates as a data signal input circuit which outputs the data signals corresponding to the blocks Grp1 to GrpM from the inputted recording data.

Synchronously with the latch signal LT, the latch circuits 108 latch the signals latched in the latch circuits 109. Thus, the block signals in the recording data are latched in the latch circuits 108. Wirings 107 consisting of total eight signal lines of non-inversion outputs Q and inversion outputs XQ of the four latch circuits 108 are connected to the blocks Grp1 to GrpM, respectively. As mentioned above, the circuit comprising the latch circuits 109 and the latch circuits 108 inputs the recording data and operates as a block signal input circuit for outputting one set of encoded block signals to the blocks Grp1 to GrpM.

In each of the blocks Grp1 to GrpM, one power transistor 102 to drive the heating element 101, one AND circuit 103 to form a driving signal to the power transistor 102, and one level converter 112 to step up an output of the AND circuit 103 and supply it to the power transistor 102 are provided for each of the heating elements 101.

The selected four of the eight wirings 107 from the four latch circuits 108 out of the block and the output signal from the common AND circuit 104 in the block are inputted to the AND circuit 103. The AND circuit 103 obtains the AND of those inputs.

Since the block signals of the wirings 107 are the encoded signals indicative of the heating elements in the block, the four signals are selected so as to select either the non-inversion output Q or the inversion output XQ of the same latch circuit 108. By getting the AND of those inputs by each AND circuit 103, a function of a decoder is realized. One of the 16 heating elements 101 in the block is selected by this decoder.

As mentioned above, the circuit comprising the AND circuits 103 decodes one set of encoded block signals and outputs the data signal adjusted to the drive timing by the enable signal HE to the selected heating element 101. Thus, the circuit operates as an output circuit for selecting the heating element 101 to be driven in accordance with the encoded block signal and the data signal from the AND circuit 104.

The VHT buffer 113 is a buffer circuit to improve the drivability to the heating element 101 and drives the level converter 112 by receiving the supply of the power voltage VHT. The output of the AND circuit 103 is stepped up by the level converter 112 and inputted to the power transistor 102.

The power transistor 102 is turned on/off in accordance with the input and controls the current supply to the heating element 101. The timing for driving the heating element 101 and a pulse width are determined by the output signal from the AND circuit 104 and the block signal from the latch circuit 108.

Figure 4:
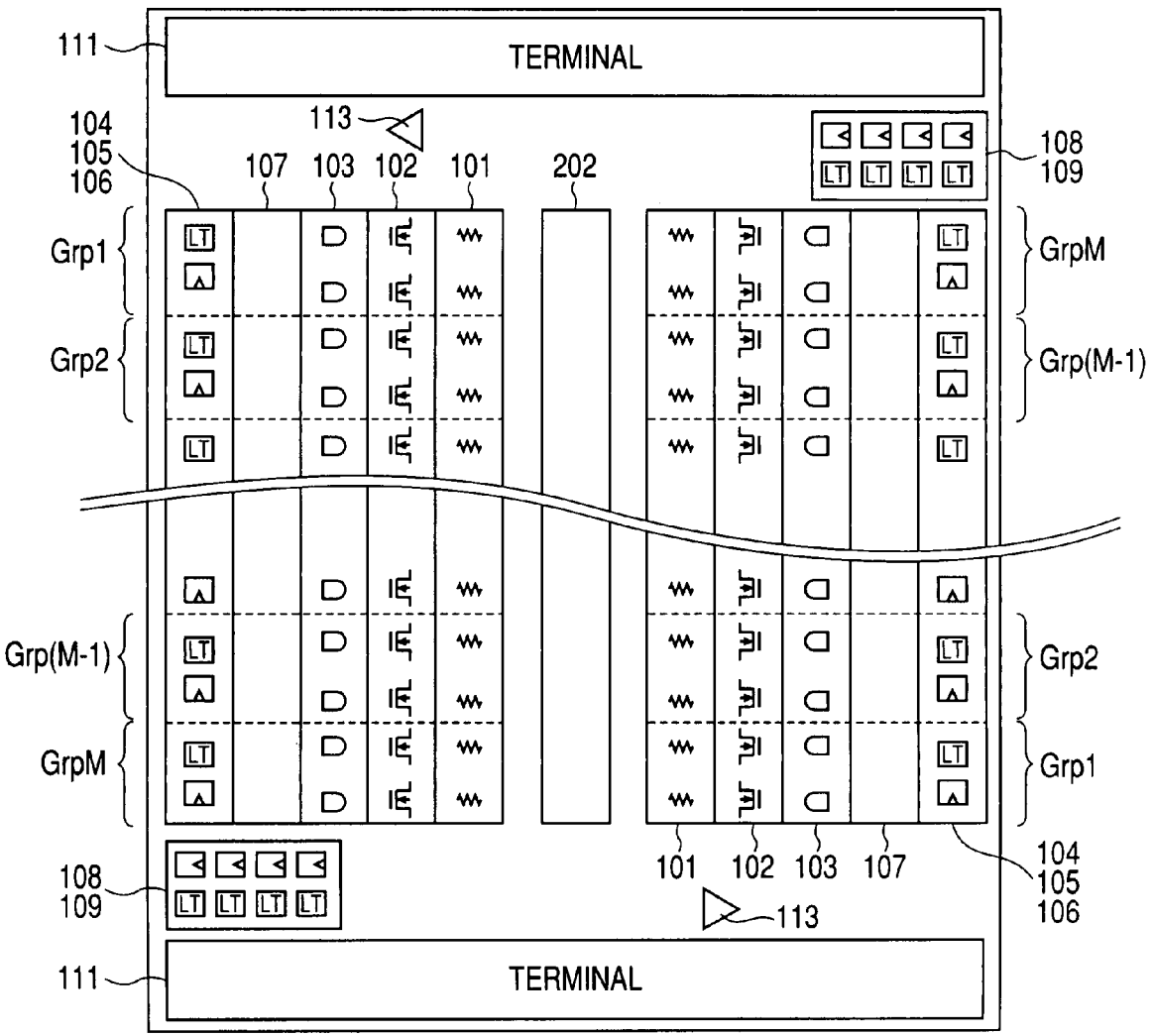
FIG. 4 is a diagram showing a layout construction of the recording head element substrate in the embodiment.

FIG. 4 is a diagram showing a layout construction of the recording head element substrate in the embodiment.

An Si (silicon) wafer or the like is used as a material (base substance) of the recording head element substrate in a manner similar to the conventional one. FIG. 4 shows a layout of each unit since it is a layout diagram and each unit shown in FIG. 3 is arranged in the portion designated by the same reference numeral as that of each unit in FIG. 3.

Referring to FIG. 4, two sets of circuits of FIG. 3 are almost point-symmetrically arranged to an ink supply port 202. Terminal areas 111 are arranged in the upper and lower positions in FIG. 4.

Signal lines (recording data DATA, latch signal LT, clock CLK, enable signal HE, heating element power voltage VH, heating element grounding voltage GNDH, driver driving power voltage VHT) which are supplied from the main body of the printer IJRA to the recording head IJH are connected to the terminal areas 111.

The blocks Grp1 to GrpM are arranged in parallel with the long side direction of the ink supply port 202. Each of the blocks Grp1 to GrpM is constructed in the direction perpendicular to the long side direction of the ink supply port 202. In each block, the latch circuits 106 and 105, AND circuit 104, 16 AND circuits 103, 16 level converters 112, 16 power transistors 102 and 16 heating elements 101 are arranged in the direction perpendicular to the long side direction of the ink supply port 202.

As mentioned above, the data signal input circuit comprising the latch circuits 105 and 106 for inputting the recording data as an input and outputting the data signal corresponding to each of the blocks Grp1 to GrpM and the AND circuit 104 is divisionally arranged in correspondence to each of the blocks Grp1 to GrpM. Each of the divided circuits is arranged in a position adjacent to the heating element 101, power transistor 102, and AND circuit 103 of the corresponding block.

The latch circuits 108 and 109 are arranged between the block GrpM and the terminal area 111. Further, the VHT buffer 113 is arranged between the block Grp1 or GrpM and the terminal area 111.

According to the embodiment, the data signal input circuit is constructed by: the shift register comprising the latch circuit 106; the latch circuit 105; and the AND circuit 104. The data signal input circuit inputs a series of data signals showing whether or not a predetermined recording element (heating element 101) in the block should be driven with respect to a plurality of blocks and outputs the data signal to each of a plurality of blocks. The construction of the data signal input circuit is divided in correspondence to the blocks. Each of the divided circuits is arranged in a position adjacent to the recording element (heating element 101) and the drive circuit (power transistor 102) of each corresponding block.

Therefore, with respect to an increase in area of the element substrate when the number of recording elements is increased, an increase in the substrate area in the direction different from the layout direction of the recording elements is suppressed and a wasteful increase in the element substrate is suppressed. Thus, the number of element substrates which can be derived from one semiconductor wafer increases and the costs of the recording head are reduced. Since there is also an effect of decreasing a wiring length owing to the decrease in layout area, radiation noises can be further suppressed.

The wiring length of each block is uniformed and shortened. An operating speed can be improved and the radiation noises can be further suppressed Since each block can be made to have the same construction, the common units can be standardized and designing efficiency and quality can be improved.

According to the embodiment, the block signal input circuit is constructed by the latch circuits 109 and 108. The block signal input circuit inputs one set of encoded block signals as shown in a predetermined recording element in the block and outputs one set of encoded block signals to each block. The recording data comprising the series of data signals and one set of block signals is inputted to the data signal input circuit and the block signal input circuit. Therefore, since the number of wirings between the recording head and the recording apparatus main body is not increased, the block signal input circuit can be applied to a control system which inputs the recording data in a serial format.

According to the embodiment, the block signal input circuit outputs both of the non-inversion output and the inversion output of each of the encoded signals as one set of block signals. The output circuit forms the driving signal to drive each recording element by getting the AND of the signals which were arbitrarily selected from them. Therefore, the circuit constructing the decoder can be divided and arranged at the position adjacent to each recording element. Thus, the increase in area of the element substrate in the case where the number of recording elements is increased is limited to that in the layout direction of the recording elements and the wasteful increase in element substrate area can be suppressed. The wiring length of each block is also shortened.

According to the embodiment, the clock signal CLK and the enable signal HE indicative of the drive timing which permits the driving of the recording element are supplied to the data signal input circuit. The serially inputted data signal is shifted by the shift register comprising the latch circuit 106 in response to the clock signal CLK and temporarily stored. The data signal stored in the shift register is latched by the latch circuit 105 at predetermined latch timing and outputted at the drive timing shown by the enable signal HE. Therefore, since the shift register can be set in the same layout direction as that of the recording elements, the wiring lengths among the latch circuits constructing the shift register can be uniformed and shortened.

Figure 5:
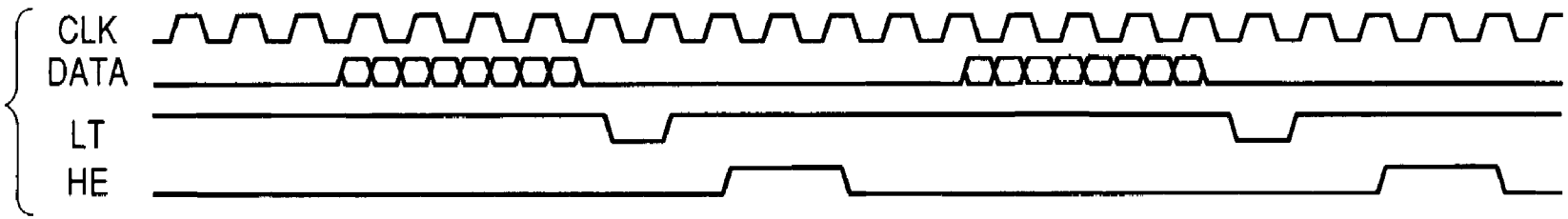
FIG. 5 is a timing chart showing a state of each signal at the time of driving the recording head in the embodiment.
Figure 6:
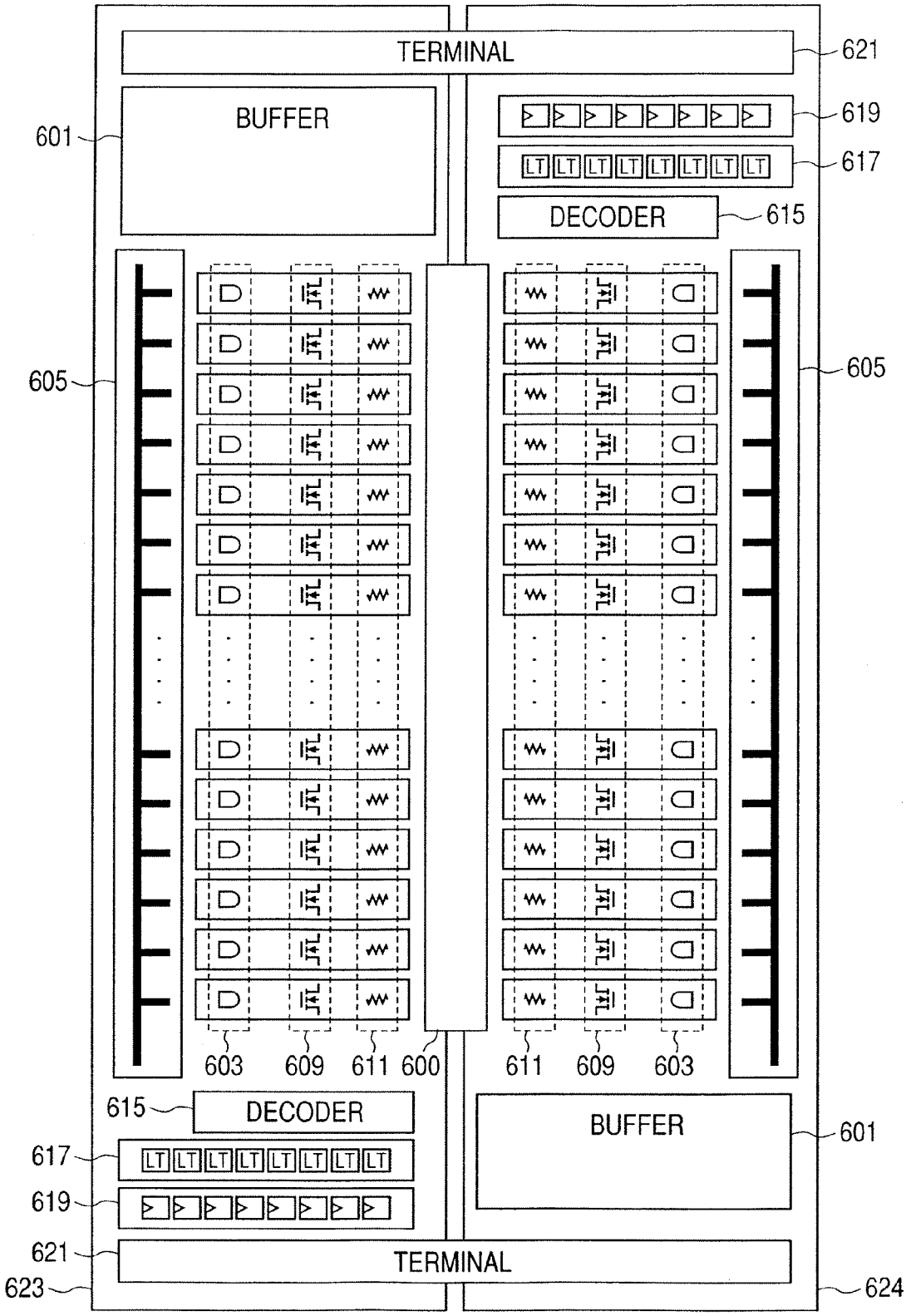
FIG. 6 PRIOR ART
FIG. 6 is a diagram showing an example of a layout construction of a conventional general recording head element substrate.

FIG. 5 is a timing chart showing a state of each signal at the time of driving the recording head IJH in the embodiment.

The recording data DATA allows the shift register constructed by the latch circuits 109 and 106 to serially shift the signal synchronously with the leading edge and the trailing edge of the clock signal CLK. Subsequently, the contents in the latch circuits 109 and 106 constructing the shift register are held in the latch circuits 108 and 105, respectively, at the timing when the latch signal LT is at the low level.

Subsequently, the selected heating elements 101 are driven and ink droplets are discharged for a period of time during which the enable signal HE is at the high level.

In the timing chart of FIG. 5, for easy understanding of the operation, there is shown an example in which the transfer timing for serially transferring the recording data DATA to the shift register and the drive timing for driving the heating elements 101 when the enable signal HE is set to the low level are separated with respect to time. However, the embodiment is not limited to such an operation. In the recording head IJH in the embodiment, the transfer timing can be made to overlap the drive timing for driving the heating elements 101 with respect to time on the basis of the data transferred at the one-preceding period. The recording speed of the printer IJRA can be improved by simultaneously executing the data transfer and the driving of the heating elements 101.

Modifications of the Embodiment

Although one VHT buffer 113 is provided for one set of circuits shown in FIG. 3 in the embodiment, another construction can be also used. For example, it is also possible to construct in such a manner that the M blocks Grp1 to GrpM are divided into halves and the two VHT buffers execute their functions, or the M blocks Grp1 to GrpM are divided into an arbitrary number of groups and the VHT buffers of the number corresponding to the division number to execute their functions are provided. As a layout in this case, it is preferable that each VHT buffer is arranged near the terminal area.

Although the embodiment uses such a construction that the driving ability of the power transistor 102 is improved by stepping up the output of the AND circuit 103 by the level converter 112, another construction can be also used. For example, if a power transistor having enough high driving ability can be used, by directly connecting the output of the AND circuit 103 to the power transistor 102, the level converter 112 and the VHT buffer 113 can be also omitted. By this construction, the circuit scale can be further reduced.

Although the circuit of FIG. 3 has such a construction that the timing for transferring the data to the shift register and the timing for driving the heating elements 101 can be overlapped with respect to the time, another construction can be also used. For example, if the recording data DATA is transferred certainly after completion of the driving of the heating elements 101 as shown in the timing chart of FIG. 5, the latch circuits 105 and 108 can be omitted from the circuit of FIG. 3. Thus, the circuit scale can be further reduced.

Although the recording data DATA is fetched into the shift register synchronously with both of the leading edge and the trailing edge of the clock signal CLK in the timing chart of FIG. 5, another construction can be also used. For example, the data can be also fetched synchronously with only either the leading edge or the trailing edge.

Although the shift register is constructed by the latch circuits of a flip-flop type which operate synchronously with the edge of the clock signal in the circuit of FIG. 3, another construction can be also used. For example, the shift register can be also constructed by the latch circuits of a through-latch type, so that the circuit scale can be further reduced.

Although the latching logic of the latch circuits 108 and 105 is set to a low-through logic in the timing chart of FIG. 5, it can be set to a high-through logic. The latch circuits 108 and 105 in the circuit of FIG. 3 can be also constructed by the flip-flop circuits. In this case, the data can be latched synchronously with the leading edge or the trailing edge or can be also latched synchronously with both of those edges.

Although the circuit of FIG. 3 has such a construction that the AND circuit 104 which is common in the block is provided at the front stage of the AND circuit 103 of each heating element 101, another construction can be also used. For example, the AND circuit 103 can be replaced with an AND gate of six inputs and the enable signal HE can be directly inputted to the AND circuit 103. As still another construction, an output of the AND in which an output of the AND of the block signal and the enable signal HE and the data signal are used as inputs can be also inputted to the level converter 112.

Although the circuit of FIG. 3 has such a construction that four wirings are selected from the eight wirings 107 of the non-inversion outputs Q and the inversion outputs XQ of the four latch circuits 108 and the AND of the five signals of the selected four wirings and the output of the AND circuit 104 is obtained by the AND circuit 103, another construction can be also used.

For example, two bits in the 4-bit block signal which has been latched and encoded by the latch circuits 108 are decoded, four signals are formed, and two signals are selected from the four signals comprising the non-inversion outputs Q and the inversion outputs XQ of the residual two bits. The selected two signals and one of the formed four signals can be also inputted to the AND circuit 103. In this case, it is preferable to use an AND gate of 4 inputs as an AND circuit 103.

As another example, three bits in the encoded block signal of four bits are decoded, eight signals are formed, and one signal is selected from the two signals comprising the non-inversion output Q and the inversion output XQ of the residual one bit. The selected one signal and one of the formed eight signals can be also inputted to the AND circuit 103. In this case, it is preferable to use an AND gate of 3 inputs as an AND circuit 103.

As further another example, the encoded block signal of four bits is fully decoded, sixteen signals are formed, and one of the 16 formed signals is selected and inputted to the AND circuit 103. In this case, it is preferable to use an AND gate of 2 inputs as an AND circuit 103.

Although it is assumed that the recording data DATA comprises the data signal of 4 bits and the block signal of 4 bits in the embodiment, the number of bits of each of the data signal and the block signal constructing the recording data DATA is not particularly limited. The order of the data signal and the block signal is also not limited to that used in the embodiment.

Although the ink jet printer and its recording head have been shown as an example in the embodiment, the invention is not limited to it. The invention can be also widely applied to a recording head for recording by a system other than the ink jet system and to a printer for recording by using such a recording head.

Although the shift register is constructed by coupling the latch circuits 109 and 106 and the recording data comprising the data signal and the block signal is serially shifted in the embodiment, the invention is not limited to it. For example, a shift register constructed by the latch circuits 109 and a shift register constructed by the latch circuit 106 are separately provided. The data signal and the block signal are supplied by different lines and the block signal and the data signal are serially shifted by the two shift registers, respectively.

EXAMPLES

Specific examples of the embodiment will now be described.

There are various systems for discharging the ink in the ink jet system. Among them, according to the system in which a heat energy generated by, for example, an electrothermal converting element, a laser beam, or the like is used as an energy for discharging the ink, a status change of the ink is caused by the heat energy, and a liquid droplet is discharged, particularly, a high density and high precision of the recording can be realized.

As its typical construction and principle, it is preferable to use fundamental construction and principle disclosed in, for example, the specifications of U.S. Pat. Nos. 4,723,129 and 4,740,796. Such a system can be applied to any of what is called an on-demand type and a continuous type.

In the case of the on-demand type, in accordance with recording information, at least one driving signal is applied to the electrothermal converting element arranged in correspondence to a sheet or a liquid path in which a liquid (ink) is held and a rapid temperature increase exceeding nucleate boiling is applied. Film boiling is consequently caused on the heat operating surface of the recording head by the heat energy generated in the electrothermal converting element, so that a bubble corresponding to the driving signal in a one-to-one corresponding relational manner is formed in the liquid (ink). Therefore, this system is effective particularly to the on-demand type. The liquid (ink) is discharged from a discharge port by growth and contraction of the bubble, so that at least one droplet is formed. By setting the driving signal into a pulse-shape, the growth and contraction of the bubble are instantaneously properly executed. Therefore, the discharge of the liquid (ink) particularly having a high response speed can be accomplished and it is more preferable.

As a pulse-shaped driving signal, the signals as disclosed in the specifications of U.S. Pat. Nos. 4,463,359 and 4,345,262 are suitable. The further excellent recording can be executed by using the conditions disclosed in the specification of U.S. Pat. No. 4,313,124 regarding a temperature rising rate of the heat operating surface.

In the invention, as a construction of the recording head, besides the combination construction (rectilinear liquid flow path or right-angled liquid flow path) of the discharge port, the liquid path, and the electrothermal converting element as disclosed in each of the foregoing specifications, it is also possible to use the construction disclosed in each of the specifications of U.S. Pat. Nos. 4,558,333 and 4,459,600 showing the construction in which the heat operating surface is arranged in a bending region.

It is also possible to use the construction disclosed in Japanese Patent Application Laid-Open No. S59-123670 showing the construction in which a slot which is common to a plurality of electrothermal converting elements is used as a discharging unit or the construction disclosed in Japanese Patent Application Laid-Open No. S59-138461 showing the construction in which an opening which absorbs a pressure wave of the heat energy is made to correspond to the discharging unit.

Further, as a recording head of a full-line type having the length corresponding to the maximum width of the recording medium which can be recorded by the recording apparatus, it is possible to use either a construction in which such a length is satisfied by a combination of a plurality of recording heads as disclosed in the foregoing specification or a construction as a single recording head which is integratedly formed.

In addition, it is possible to use not only a recording head of a cartridge type in which an ink tank is provided integratedly for the recording head itself described in the embodiment but also a recording head of an exchangeable chip type in which by attaching the recording head to the apparatus main body, electrical connection to the apparatus main body and supply of the ink from the apparatus main body can be performed.

If recovery means, spare means, and the like for the recording head are added to the construction of the recording apparatus described above, the recording operation can be further stably executed, so that such a structure is preferable. Specifically speaking, capping means for the recording head, cleaning means, pressing or sucking means, electrothermal converting elements or other heating elements, spare heating means comprising a combination of them, and the like can be mentioned. If a spare discharging mode for executing a discharge different from the recording is provided, it is effective to execute the stable recording.

Further, a recording mode of the recording apparatus is not limited to only the recording mode of only the main stream color such as black or the like but can be constructed as an apparatus having at least one of a recording mode of a multicolor of different colors or a recording mode of a full color based on the color mixture by integratedly constructing the recording head or combining a plurality of recording heads.

Although the embodiment has been described on the assumption that the ink is a liquid, ink which is solidified at room temperatures or temperatures below them or ink which is softened or liquefied at room temperatures can be used. In the ink jet system, since it is a general way to control viscosity of the ink into a stable discharging range by adjusting the temperature of the ink itself so as to lie within a range of 30° or more and 70° or less, it is sufficient to use the ink so long as it is liquefied when the recording signal is supplied.

Further, the temperature elevation by the heat energy can be also actively used as an energy for a status change from the solid state to the liquid state of the ink. Ink which is solidified in a leaving state and liquefied by heating can be also used to prevent the ink from being evaporated. The invention can be also applied to a case of using ink which is liquefied for the first time by applying the heat energy, such as case where the ink is liquefied by applying the heat energy according to the recording signal and the liquid ink is discharged, case where the solidification has already started at a point of time when the discharged ink reaches the recording medium, or the like.

In such a case, it is also possible to use such a construction that the ink faces the electrothermal converting element in the state where the ink is held as a liquid or solid matter in a porous sheet concave portion or a through-hole as disclosed in Japanese Patent Application Laid-Open No. S54-56847 or Japanese Patent Application Laid-Open No. S60-71260. In the invention, the foregoing film boiling system is most effective for each ink.

The invention can be applied to a system constructed by a plurality of apparatuses (for example, a host computer, an interface unit, a reader, a printer, etc.) or an apparatus comprising one device (for example, a copying apparatus, a facsimile apparatus, or the like).

This application claims priority from Japanese Patent Application No. 2004-168822 filed on Jun. 7, 2004, which is hereby incorporated by reference herein.

What is claimed is:

1. A liquid discharging head comprising:

a plurality of recording elements which are arranged in a predetermined direction and divided into a plurality of blocks, and each of which generates energy for discharging a liquid;

a plurality of drive circuits for supplying currents to said recording elements and driving them;

a first input circuit for inputting a series of data signals showing whether or not a predetermined recording element in a given block should be driven with respect to said plurality of blocks, and outputting the data signals to said plurality of blocks, respectively;

a second input circuit for inputting one set of block signals encoded so as to indicate said predetermined recording element in the given block and outputting said one set of block signals to the given block; and a plurality of output circuits for outputting signals for driving said drive circuits in accordance with said data signals from said first input circuit and said block signals from said second input circuit, wherein said first input circuit is divided into a plurality of portions corresponding to said blocks, respectively, and each of the portions is arranged in a position adjacent to said recording element of said corresponding block and said drive circuit corresponding to said recording element, and wherein said second input circuit outputs both a non-inversion output and an inversion output of each of the encoded signals as said one set of block signals, and each of said output circuits has an AND circuit for calculating a logical product of the data signal derived from said first input circuit and a signal arbitrarily selected from said one set of block signals derived from said second input circuit, and outputs a respective driving signal for driving a respective recording element to a respective drive circuit based on a result of the calculation by said AND circuit.

2. A head according to claim 1, wherein recording data comprising said series of data signals and said one set of block signals is inputted to said first input circuit and said second input circuit.

3. A head according to claim 1, wherein said first input circuit comprises:

a shift register to which a clock signal and an enable signal indicative of a drive timing for permitting the driving of said recording elements are supplied and which shifts said data signals which were serially inputted in accordance with said clock signal and temporarily stores the shifted data signals; and a latch circuit for latching said data signals stored in said shift register at a predetermined latch timing, wherein an output of said latch circuit is outputted at said drive timing shown by said enable signal.

4. A head according to claim 1, wherein said second input circuit comprises:

a shift register to which a clock signal is supplied and which shifts said serially inputted block signals in accordance with said clock signal and temporarily stores them; and a latch circuit for latching said block signals stored in said shift register at a predetermined latch timing.

5. A head according to claim 1, further comprising a plurality of step-up circuits for stepping up the outputs of said output circuits and supplying them to said drive circuits.

6. A head according to claim 1, wherein each of said recording elements comprises a heating element.

7. A recording apparatus comprising:

a recording head comprising a liquid discharging head according to claim 1; and a controlling and processing unit for controlling the supply of the signals to said liquid discharging head.

* * * * *

UNITED STATES PATENT AND TRADEMARK OFFICE

CERTIFICATE OF CORRECTION

PATENT NO. : 7,328,957 B2
APPLICATION NO. : 11/139525
DATED : February 12, 2008
INVENTOR(S) : Yasuo Fujii It is certified that error appears in the above-identified patent and that said Letters Patent is hereby corrected as shown below:

COLUMN 5:
Line 9, “is come” should read -- comes --.
Line 42, “is come” should read -- comes --.

COLUMN 9:
Line 27, “suppressed” should read -- suppressed. --.

Signed and Sealed this

Twenty-sixth Day of May, 2009

JOHN DOLL
*Acting Director of the United States Patent and Trademark Office*